US005316256A

United States Patent [19]

Siebenaler et al.

[11] Patent Number: 5,316,256

[45] Date of Patent: May 31, 1994

[54] RACK FOR READING MATERIAL

[76] Inventors: James L. Siebenaler, 3 Linwood, Bloomington, Ill. 61701; Herman P. Valentine, 5547 Lindford Ave. NE., North Canton, Ohio 44721

[21] Appl. No.: 21,089

[22] Filed: Feb. 24, 1993

[51] Int. Cl.[5] ..... A47B 97/04

[52] U.S. Cl. ..... 248/453; 248/460

[58] Field of Search ..... 248/441.1, 447, 448, 248/453, 460, 462, 458

[56] References Cited

U.S. PATENT DOCUMENTS

| | | | |
|---|---|---|---|
| 1,942,456 | 1/1934 | Stark | 211/42 |
| 2,117,668 | 5/1938 | Johnson | 211/42 |
| 2,592,252 | 4/1952 | De Coste | 211/43 |
| 3,429,541 | 2/1969 | Herman . | |
| 4,448,384 | 5/1984 | Jones, Jr. et al. | 248/448 X |
| 4,508,307 | 4/1985 | Morales | 248/448 X |
| 4,948,082 | 8/1990 | Pagano | 248/453 X |

*Primary Examiner*—Ramon O. Ramirez

*Attorney, Agent, or Firm*—Paul E. Milliken; Lee A. Germain

[57] ABSTRACT

A removeable reading rack for mounting on the front face of an instrument console of an exercise machine. The rack is made of two spaced apart upwardly extending frame members each having an upper hook portion for engaging the top edge of the exercise console and an up-turned lower hook portion for engaging and supporting the lower edge of a book or other reading material. The lower hook portions of the spaced apart members are both pivotally connected to a horizontal frame member so that the rack can be folded compactly for transporting or storage when not in use.

20 Claims, 3 Drawing Sheets

RACK FOR READING MATERIAL

FIELD OF THE INVENTION

This invention relates to reading racks and in particular to racks which may be removably attached to the instrument panel consoles of exercise machines to support books, magazines and other reading material so that it may be read by a person using the exercise machine.

BACKGROUND OF THE INVENTION

Various types of racks have been devised in the past to hold books or other reading materials so that it can be read by a person while keeping the person's hands free to perform other activities. Some of these racks served a dual purpose of reading racks and book ends. Typical examples of such book rests or reading racks may found in U.S. Pat. Nos.: 1,942,456, Stark; 2,117,668, Johnson; 2,592,252, de Coste; and 3,429,541, Herman. None of these prior art devices provide a rack designed to be mounted on the console of an exercise machine.

Many people who use various type of exercise machines such as a stationary bicycle or other exercise machine where a repetitive exercise is performed for a considerable period of time, become bored and would like to be able to read while performing the exercise. If they attempt to hold a book, magazine, or newspaper in their hands, while using the exercise machine, this sometimes becomes cumbersome and detracts from the exercise. Also their hands can become sweaty and they are likely to damage the reading material.

OBJECTS OF THE INVENTION

It is an object of this invention to provide a simple inexpensive reading rack which can be easily attached to the console of an exercise machine to permit an individual to read books and other reading material while performing a repetitive exercise on the machine, then to easily remove the rack from the machine when the exercise is completed.

Another object of this invention is to provide a reading rack which in simple to manufacture and use.

A further object of this invention is to proved a reading rack which is lightweight and easily foldable into a compact package when not in use.

Still another object of the invention is to provide a reading rack which has a resilient surface coating to prevent damage to the console of an exercise machine when it is mounted thereon.

These and other objects of the invention will become apparent in the following specification and the accompanying drawings.

SUMMARY OF THE INVENTION

A removeable rack for supporting articles of reading material on an instrument panel face of an exercise machine console which face is oriented in an upwardly inclined plane for convenient viewing by a user of the machine, said console having a substantially horizontally extending upper edge at the top of the panel face, the rack comprising: attachment means at the top of the rack for suspending the rack from the upper edge of the console, intermediate means extending downwardly from the attachment means across the instrument panel face when the rack is in the operative position on the console said intermediate means lying in a common inclined plane with the instrument panel face so that any reading material placed on the rack will lie against both the intermediate means and the instrument panel face, and reading material support means extending forwardly and upwardly from the bottom of the intermediate means to engage a bottom edge of any reading material placed on the rack, to prevent such material from sliding off the rack.

DESCRIPTION OF THE PREFERRED EMBODIMENTS

Figure 1:
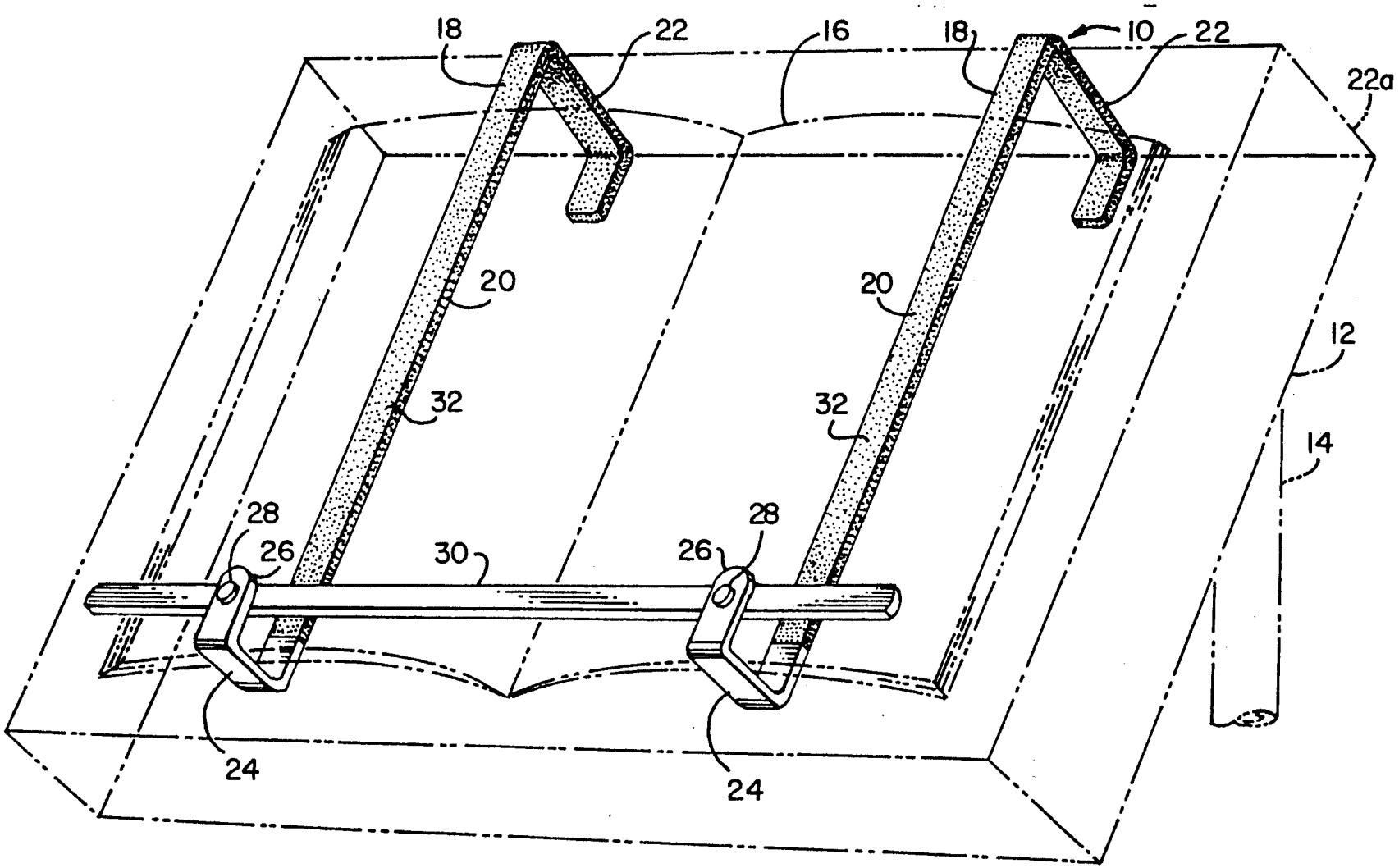
FIG. 1 is a perspective view of the rack of the invention mounted for use on the console of an exercise machine and having an item of reading material supported by the rack.
Figure 3:
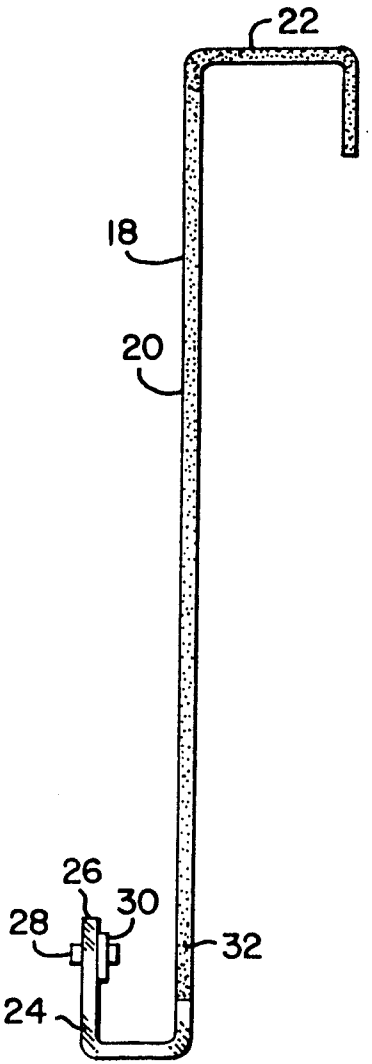
FIG. 3 is a right end profile view of the reading rack shown in FIG. 2.
Figure 2:
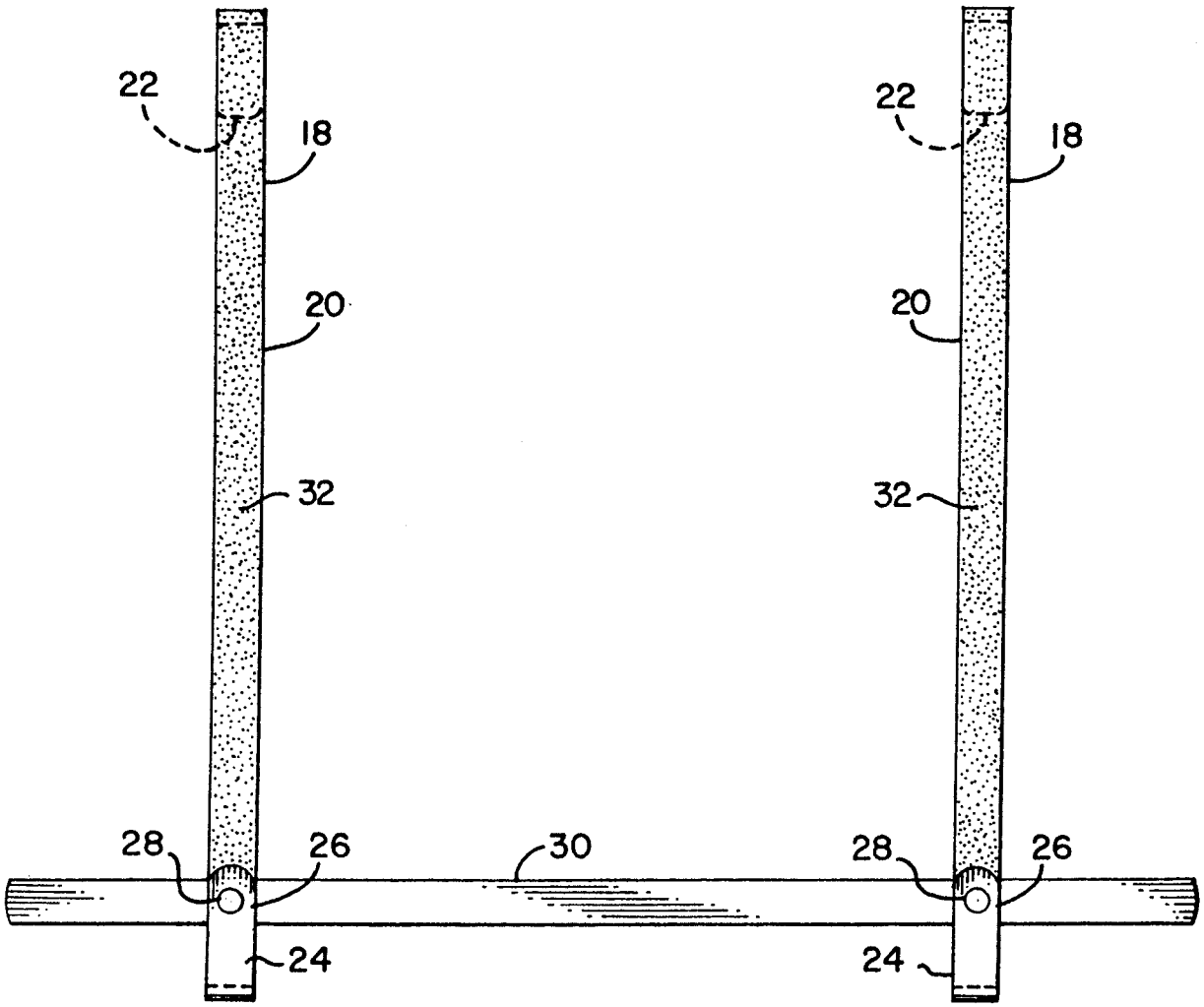
FIG. 2 is a front elevational view of the reading rack of the invention.

Referring now to FIGS. 1 through 3 of the drawings, a reading rack indicated generally by the numeral 10 is removably mounted on a console 12 of an exercise machine (not shown). The console 12 is supported by a plurality of upwardly extending posts 14. As shown in FIG. 1 the rack supports an article of reading material 16. The rack is suitable for books, magazines, newspapers and other articles of reading material.

The rack 10 has a pair of upwardly extending spaced apart frame members 18. The frame members 18 are substantially identical to each other and each frame member 18 has an upwardly extending intermediate portion 20 with an upper hook portion or L-shaped portion 22 extending rearwardly from the upper end of the intermediate portion 20 and downwardly to engage an upper edge 22*a* of the console 12. A lower hook portion or L-shaped portion 24 extends forwardly from the lower end of the intermediate portion 20 and serves as a support and retaining member for the reading material 16 as shown in FIG. 1 which prevents the reading material from sliding downwardly on the rack 10.

Each of the lower L-shaped portions 24 has an upwardly extending tab portion 26 through which a rivet 28 passes to attach the portion 26 to a horizontal frame member 30. The rivets 28 passing through the tab portions 26 and the frame member 30 can be sufficiently loose to permit the frame member 30 and the tab portion to pivot with respect to each other so that the frame members 18 can be folded downwardly to lie substantially parallel to the frame member 30 and thereby provide a compact item for carrying or storage.

The frame members 18 and 30 of the rack 10 as shown herein, are made preferably of flat steel bar stock but may be made of round or tubular stock and can be made of plastic or other materials.

When made of steel, the frame members 18 are covered with a coating 32 of plastic or elastomeric material to protect the surface of the console 12 when the rack is mounted thereon. The coating preferably covers all portions of the frame members 18 that may come in contact with the console 12 but does not cover the area of the member 18 which contacts the horizontal frame member 30 since the coating would interfere with folding the rack 10 about the rivets 28. The coatings are preferably made in a bright color to make the rack 10 more attractive when in use. The portions of the steel frame members not covered by plastic can be plated to make them more attractive and to protect them from rust and corrosion.

Figure 4:
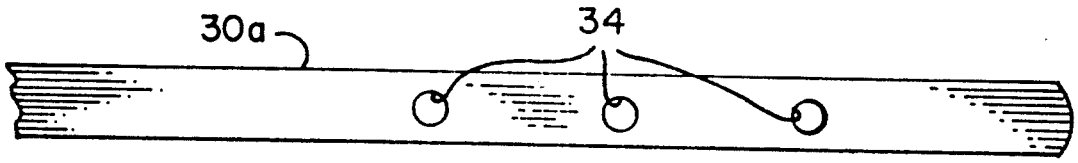
FIG. 4 is a fragmentary front elevational view of a horizontal frame member of the reading rack of the invention showing an adjustable width embodiment of the invention.

In order to provide for adjustable width of the rack 10, a horizontal frame member 30*a* (FIG. 4) having multiple spaced apart holes 34 near each end thereof may be substituted for frame member 30 and permits the members 18 to be spaced at various distances from each other depending upon which holes are is used for connecting the members 18 to the member 30*a*.

Figure 5:
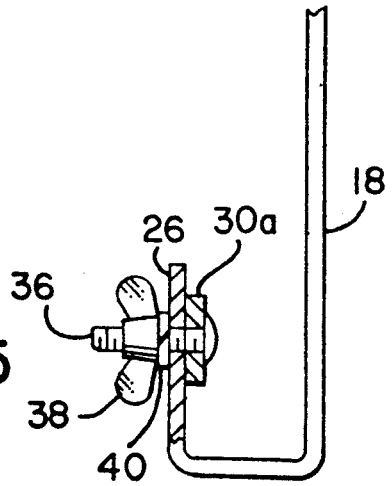
FIG. 5 is a fragmentary right end profile similar to FIG. 3 but showing an adjustable width embodiment of the invention.

As shown in FIG. 5, the frame member 30*a* can be attached to tabs 26 of member 18, by screws 36 passing through the holes 34 and wing nuts 38 tightened down against lock washers 40.

When it is desired to fold up the rack 10 the wing nuts 38 are loosed to permit the frame members 18 and 30*a* to pivot with respect to each other around the screws 36.

The rack describe above can vary in size, however the rack is normally made of such proportions that it will fit on most any console used on an exercise machine with the intermediate members resting against the front face of the console. When reading material such as material 16 shown in FIG. 1 is placed on the rack 10 the reading material lies on top of the intermediate portions 20 with the lower edge of the reading material resting on the forwardly extending portion of the lower L-shaped portion 24. The tab portions 26 and the horizontal frame member 30 extend over the reading material adjacent to the bottom edge of the material and prevent it from sliding off the lower L-shaped member 24. Since the console is tilted rearwardly the book lies against the intermediate portions 20 and against the front face of the console 12. The combination of the rack 10 backed by the support from the face of the console 12 provides a very stable retainer for the reading material without the need for a bulky or heavy rack.

Various other embodiments of racks may also be used without departing from the scope of the invention.

We claim:

1. A rack for supporting articles of reading material on an instrument panel face of an exercise machine console which face is oriented in an upwardly inclined plane for convenient viewing by a user of the machine, said console having a substantially horizontally extending upper edge at the top of the panel face, the rack comprising:

at least two substantially parallel spaced apart elongated upwardly extending frame members each having;

an upwardly extending intermediate portion having an upper and lower end;

an upper hook portion extending rearwardly from the upper end of the intermediate portion and downwardly to engage the upper edge of the console; and a lower hook portion extending forwardly from the lower end of the intermediate portion and upwardly to provide a support for reading material placed on the rack; and an elongated horizontal frame member extending between the upwardly extending frame members and attached to each of such frame members to hold them in spaced relationship to each other.

2. A rack as claimed in claim 1 wherein the upwardly extending frame members are attached by a pivotal means to the horizontal frame member to permit the rack to be folded into a compact unit.

3. A rack as claimed in claim 2 wherein the pivotal means attaching the upwardly extending frame members to the horizontal member is adapted to be tightened to prevent relative movement of the frame members with respect to each other while the rack is in use.

4. A rack as claimed in claim 2 wherein the horizontal frame member has a series of spaced apart holes at various locations along at least part of its length and wherein the pivotal means attaching the upwardly extending frame members to the horizontal frame member can be selectively located through such holes in the horizontal frame member that will provide the desired width between the upwardly extending frame members.

5. A rack as claimed in claim 1 wherein the upwardly extending frame members and the horizontal frame member are all made of flat steel bar stock.

6. A rack as claimed in claim 1 wherein the upper hook portion and the lower hook portion of each upwardly extending frame member are covered with a protective plastic coating in the area of contact between the rack and the top edge of the console and between the rack and a bottom edge of any reading material placed on the rack.

7. A rack as claimed in claim 1 wherein the intermediate portion of each upwardly extending frame member lies substantially flat against the instrument panel face of the console whereby the panel face provides a substantially flat supporting surface directly behind the rack to provide additional stability for any article of reading matter placed in the rack.

8. A removeable rack for supporting articles of reading material on an instrument panel face of an exercise machine console which face is oriented in an upwardly inclined plane for convenient viewing by a user of the machine, said console having a substantially horizontally extending upper edge at the top of the panel face, the rack comprising:

attachment means at the top of the rack for suspending the rack from the upper edge of the console;

intermediate means extending downwardly from the attachment means across the instrument panel face when the rack is in the operative position on the console said intermediate means lying in a common inclined plane with the instrument panel face so that any reading material placed on the rack will lie against both the intermediate means and the instrument panel face; and reading material support means extending forwardly and upwardly from the bottom of the intermediate means to engage a bottom edge of any reading material placed on the rack, to prevent such material from sliding off the rack.

9. A rack as claimed in claim 8 wherein the rack is of open frame construction.

10. A rack as claimed in claim 9 wherein the rack has elongated frame members of flat bar material.

11. A rack as claimed in claim 9 wherein the rack is foldable.

12. A rack as claimed in claim 8 wherein the attachment means and the reading material support means are covered with a resilient coating.

13. A removeable rack for supporting articles of reading material on an instrument panel face of an exercise machine console which face is oriented in an upwardly inclined plane for convenient viewing by a user of the machine, said console having a substantially horizontally extending upper edge at the top of the panel face, the rack comprising:

a pair of substantially identical and parallel spaced apart elongated upwardly extending frame members each having;

an upwardly extending intermediate portion having an upper and lower end;

an upper "L"-shaped portion extending rearwardly from the upper end of the intermediate portion and downwardly to engage the upper edge of the console; and a lower "L"-shaped portion extending forwardly from the lower end of the intermediate portion and upwardly to provide a support for reading material placed on the rack; and an elongated horizontal frame member extending between the upwardly extending frame members and having each end of the horizontal frame member attached to each of the upwardly extending frame members at the upwardly extending part of the lower "L"-shaped portion to hold the upwardly extending frame members in spaced relationship to each other.

14. A rack as claimed in claim 13 wherein the upwardly extending frame members are attached by a pivotal means to the horizontal frame member to permit the rack to be folded into a compact unit.

15. A rack as claimed in claim 14 wherein the pivotal means attaching the upwardly extending frame members to the horizontal member is adapted to be tightened to prevent relative movement of the frame members with respect to each other while the rack is in use.

16. A rack as claimed in claim 14 wherein the horizontal frame member has a series of spaced apart holes at various locations along at least part of its length and wherein the pivotal means attaching the upwardly extending frame members to the horizontal frame member can be selectively located through such holes in the horizontal frame member that will provide the desired width between the upwardly extending frame members.

17. A rack as claimed in claim 13 wherein the upwardly extending frame members and the horizontal frame member are all made of flat steel bar stock.

18. A rack as claimed in claim 13 wherein the upper "L"-shaped portion and the lower "L"-shaped portion of each upwardly extending frame member is covered with a protective plastic coating in the area of contact between the rack and the top edge of the console and between the rack and a bottom edge of any reading material placed on the rack.

19. A rack as claimed in claim 13 wherein each of the upwardly extending frame members are made from a single continuous piece of material which are contoured to provide both the upper and the lower "L"-shaped portions at each end thereof.

20. A rack as claimed in claim 13 wherein the intermediate portion of each upwardly extending frame member lies substantially flat against the instrument panel face of the console whereby the panel face provides a substantially flat supporting surface directly behind the rack to provide additional stability for any article of reading material placed in the rack.

* * * * *